US010808425B2

(12) United States Patent
Snell

(10) Patent No.: US 10,808,425 B2
(45) Date of Patent: Oct. 20, 2020

(54) SPRING LOADED LOCK BOLT

(71) Applicant: CIW Enterprises, Inc., Mountain Top, PA (US)

(72) Inventor: Jacob R. Snell, Duryea, PA (US)

(73) Assignee: CORNELLCOOKSON, LLC, Mountain Top, PA (US)

( * ) Notice: Subject to any disclaimer, the term of this patent is extended or adjusted under 35 U.S.C. 154(b) by 312 days.

(21) Appl. No.: 15/436,944

(22) Filed: Feb. 20, 2017

(65) Prior Publication Data

US 2018/0238082 A1 Aug. 23, 2018

(51) Int. Cl.

| | |
|---|---|
| ***E05B 65/00*** | (2006.01) |
| ***E05B 15/02*** | (2006.01) |
| ***E05C 9/22*** | (2006.01) |
| ***E05B 65/08*** | (2006.01) |
| ***E05C 9/04*** | (2006.01) |

(52) U.S. Cl.

CPC ..... *E05B 65/0021* (2013.01); *E05B 15/0205* (2013.01); *E05B 65/0876* (2013.01); *E05C 9/04* (2013.01); *E05C 9/22* (2013.01)

(58) Field of Classification Search

CPC ..... E05B 65/0021; E05B 15/0205; E05B 65/0876; E05C 9/04; E05C 9/22

USPC ..... 70/100; 292/163, 164, DIG. 51, DIG. 55

See application file for complete search history.

(56) References Cited

U.S. PATENT DOCUMENTS

| | | | | |
|---|---|---|---|---|
| 1,959,192 | A * | 5/1934 | Bates, Jr. | E05G 1/00 292/2 |
| 2,867,466 | A * | 1/1959 | Stroup | E05B 65/0021 292/227 |
| 2,927,811 | A * | 3/1960 | Rea | E05B 51/02 292/144 |
| 4,015,454 | A * | 4/1977 | Struble | E05C 1/08 292/150 |
| 4,739,584 | A | 4/1988 | Zellman | |
| 5,489,130 | A | 2/1996 | Clark | |
| 7,011,347 | B2 * | 3/2006 | Finardi | E05B 65/0021 160/201 |
| 7,152,889 | B2 * | 12/2006 | Jeffries | E05B 65/0021 292/215 |
| 8,959,838 | B1 * | 2/2015 | Marinelli | E05B 77/12 292/137 |
| 2007/0120377 | A1 | 5/2007 | King et al. | |
| 2013/0056995 | A1 * | 3/2013 | Hudson | E05B 65/0021 292/181 |
| 2015/0061300 | A1 * | 3/2015 | Hudson | E05D 15/16 292/164 |

* cited by examiner

*Primary Examiner* — Suzanne L Barrett

(74) *Attorney, Agent, or Firm* — Morgan, Lewis & Bockius LLP

(57) ABSTRACT

A lock for a retractable door that is moveable along a track may include a pin assembly coupled to the door and moveable with respect to the door from a retracted configuration to an extended configuration. A biasing element may bias the pin toward the extended configuration. A strike plate may be in the track and be configured to mate with the pin assembly. The door may be prevented from moving along the track when the pin assembly is mated with the strike plate.

26 Claims, 11 Drawing Sheets

SPRING LOADED LOCK BOLT

BACKGROUND OF THE INVENTION

The present invention generally relates to a lock bolt for a door and, more particularly, to a spring loaded lock bolt for an overhead rolling door.

Overhead doors are commonly found on garages, as security grilles for retail stores, window sills, and other applications. Overhead doors can include roll up types, track types, swing up types, etc. These doors may move vertically along a track from a stored position to a closed position where the door substantially obstructs the doorway. It is preferable that these overhead doors have a lock to secure the doors in the closed position. When the lock is located at a midway point up the door, trespassers may apply a force to the lower end of the door bypassing the lock and creating an accessway enabling passage of a trespasser without fully opening the door. Furthermore, it is desirable in a retail setting to allow consumers to view merchandise through a security grille even when a retail store is closed. Such visibility is reduced when the lock is located at a midway point of the door. Thus, the lock is typically positioned at the lower end of the door.

Positioning the lock at the lower end of the door presents its own challenges. For example, the lock typically requires a user to first close the door and then bend down to activate the lock. However, users may not perform the locking procedure in this sequential order and may instead activate the lock before the door is fully closed and then close the door. This can cause unwanted wear and tear on the door as the locking element contacts a strike plate associated with the track.

Thus, a door with a lock element which can be locked either before or after the door is closed without damaging the door or associated door frame is desired.

BRIEF SUMMARY OF THE INVENTION

In one embodiment, a lock for a retractable door that is moveable along a track may comprise a pin assembly coupled to the door and moveable with respect to the door from a retracted configuration to an extended configuration; a biasing element configured to bias the pin assembly toward the extended configuration; and a strike plate in the track, the strike plate configured to mate with the pin assembly. The door may be prevented from moving along the track when the pin assembly is mated with the strike plate. The pin assembly may be coupled to the door and moveable with respect to the door, between a first position and a second position. The door may be lockable when the bolt is in the second position. The pin assembly may be adapted to move in concert with the bolt from the first position to the second position and move independently of the bolt from the retracted configuration to the extended configuration. The pin assembly may be adapted to move from the extended configuration to the retracted configuration as the door moves relative to the strike plate while the pin assembly is engaged with the strike plate.

In a further embodiment, the lock may comprise a locking element adapted to lock the bolt in the second position. The locking element may be adapted to attain the second position whether or not the pin is mated with the strike plate. The lock may be configured to cooperate with the door and the track such that when the bolt is in the second position, at least a portion of the pin assembly is disposed within the track and the door is moveable along the track when the pin assembly is within a free portion of the track and the door is not moveable along the track when the pin assembly is mated with the strike plate. The retractable door may include a housing configured to receive the pin assembly. In a further embodiment, the door may include a plug having an aperture configured to align the pin assembly with the strike plate, with the pin assembly configured to extend through the aperture. In a further embodiment, the door may comprise a stabilizer coupled to the pin assembly, the stabilizer aligning the pin assembly with the aperture. The stabilizer may be fixed to the pin assembly and the stabilizer may move as the pin assembly transfers between the contracted configuration and the extended configuration. The stabilizer may be adjacent the plug when the pin assembly is in the extended configuration and may be spaced from the plug when the pin assembly is in the contracted configuration. The biasing element may be a spring and the spring may be un-stressed when the pin assembly is in the extended configuration.

The lock may be configured to transition into a locked configuration when the bolt is in the second position and the pin assembly is in the extended configuration by the movement of the door along the track toward the strike plate such that the biasing element compresses when the pin assembly engages the strike plate and decompresses when the pin assembly is aligned with an opening in the strike plate such that the pin assembly extends into the opening. The lock may be configured to permit the door to be secured when the bolt is in the first position and the pin is in the extended configuration such that the biasing element remains uncompressed as the pin passes the strike plate and the bolt is moved to the second position such that the pin is within the opening. The strike plate may include an opening and the pin assembly mates with the strike plate when the pin assembly is within the opening. The strike plate may include a ramp portion extending away from the track, wherein the pin assembly is movable to the contracted configuration when the pin assembly engages the ramp. The strike plate may include a face with an opening and the pin assembly is configured to mate with the strike plate when a portion of the pin assembly is disposed within the opening. The strike plate may include a foot configured to be secured to a surface at a lower end of the track. The strike plate may include an offset portion between the face and the foot, the offset portion configured to engage the track.

In one embodiment, a method of securing a retractable door may comprise moving a bolt with respect to the retractable door from a first position to a second position, the bolt movably coupled to a pin assembly moveable with respect to the bolt from a retracted configuration to an extended configuration; locking the bolt in the second position; moving the door while the pin assembly is in the extended configuration; engaging a strike plate with the pin assembly, thereby transferring the pin assembly to the retracted configuration; and aligning the pin assembly the strike plate, thereby transferring the pin assembly to the extended configuration wherein the pin assembly is mated with the strike plate. The bolt may include a channel and the pin assembly may include an arrester within the channel configured to limit movement of the pin assembly with respect to the bolt. The moving the bolt step may include moving the pin assembly in concert with the bolt, and the engaging the strike plate step may include moving the pin assembly independently of the bolt. The pin assembly may move between the extended configuration and the retracted configuration after the locking step. The moving a bolt step may include moving the bolt and a second bolt with an actuator, the second bolt may move with respect to the door from a first position to a second position, the second bolt may be coupled to a second pin moveable with respect to the second bolt between an extended configuration and a retracted configuration with a second biasing element biasing the pin to the extended configuration.

A method of securing a retractable door may comprise providing a retractable door having a bolt moveable between a first position and a second position, a pin assembly moveable from a contracted configuration to an extended configuration, the door moveable along a track including a strike plate. The method may include closing the retractable door when the bolt is in the first position and the pin assembly is in the extended configuration such that the biasing element is uncompressed as the pin assembly passes the strike plate and the bolt is moved to the second position such that the pin assembly is mated with the strike plate. The method may include opening the door; and closing the door when the bolt is in the second position and the pin assembly is in the extended configuration such that the biasing element is compressed as the pin assembly passes the strike plate and decompresses when the pin assembly is aligned with the opening such that the assembly extends into the opening. In a further embodiment, the method includes retrofitting the bolt, pin assembly, and biasing element into an existing door by replacing a lock bar coupled to the existing door with the bolt, pin, and biasing element. The lock bar may be housed within a housing of the existing door and the method may further comprise accessing the lock bar within the housing prior to the replacing the lock bar step. The retrofitting step may be performed while the door is engaged with the track.

BRIEF DESCRIPTION OF THE SEVERAL VIEWS OF THE DRAWINGS

The foregoing summary, as well as the following detailed description of embodiments of the spring loaded lock bolt, will be better understood when read in conjunction with the appended drawings of an exemplary embodiment. It should be understood, however, that the invention is not limited to the precise arrangements and instrumentalities shown.

In the drawings.

DETAILED DESCRIPTION OF THE INVENTION

Figure 1:
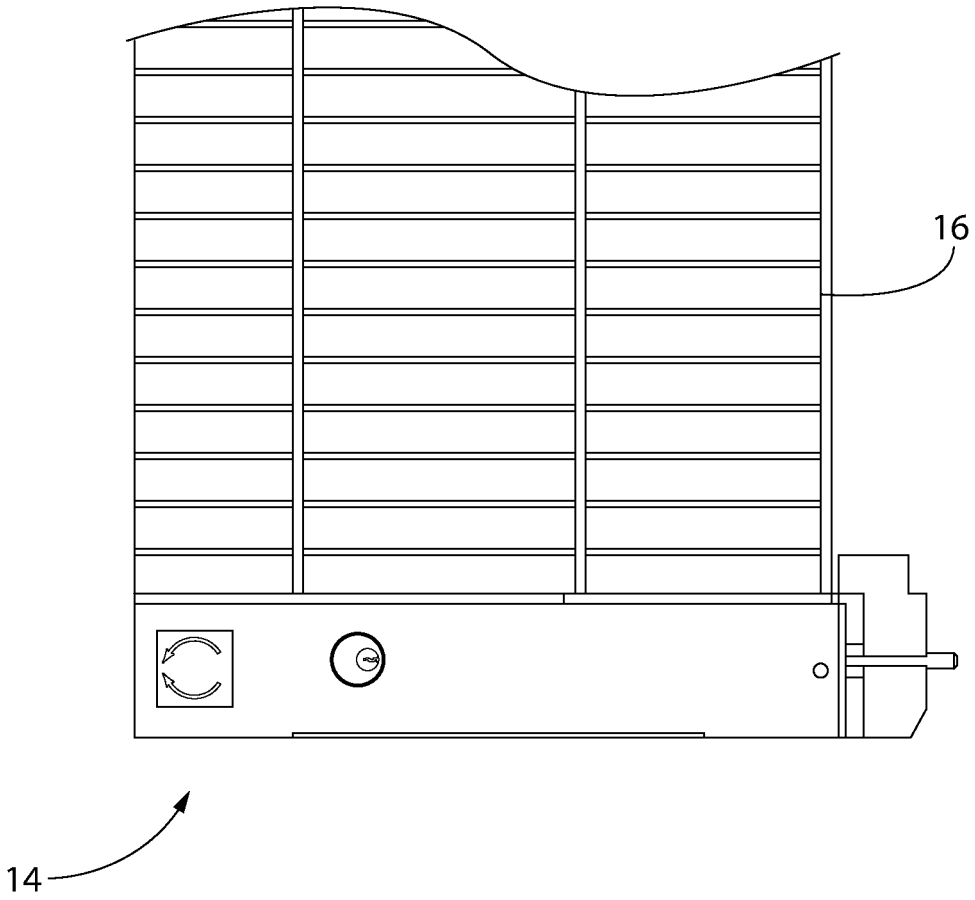
FIG. 1 is a front elevational view of a door with a lock in accordance with an exemplary embodiment of the present invention.

Referring to the drawings in detail, wherein like reference numerals indicate like elements throughout, there is shown in FIGS. 1-11 a lock, generally designated 14, in accordance with an exemplary embodiment of the present invention.

Referring now to FIG. 1, the lock 14 may be attached to a door 16 by welding, adhesive, connectors (e.g. nails, screws, dowels) etc. The door 16 may be an overhead rolling door, a security grille, a track type door, a swing up type door, or any other type of device which serves to obstruct a doorway or opening. The lock 14 may secure the door 16 in position when it is in an open position, a closed position, or anywhere in between.

Figure 2:
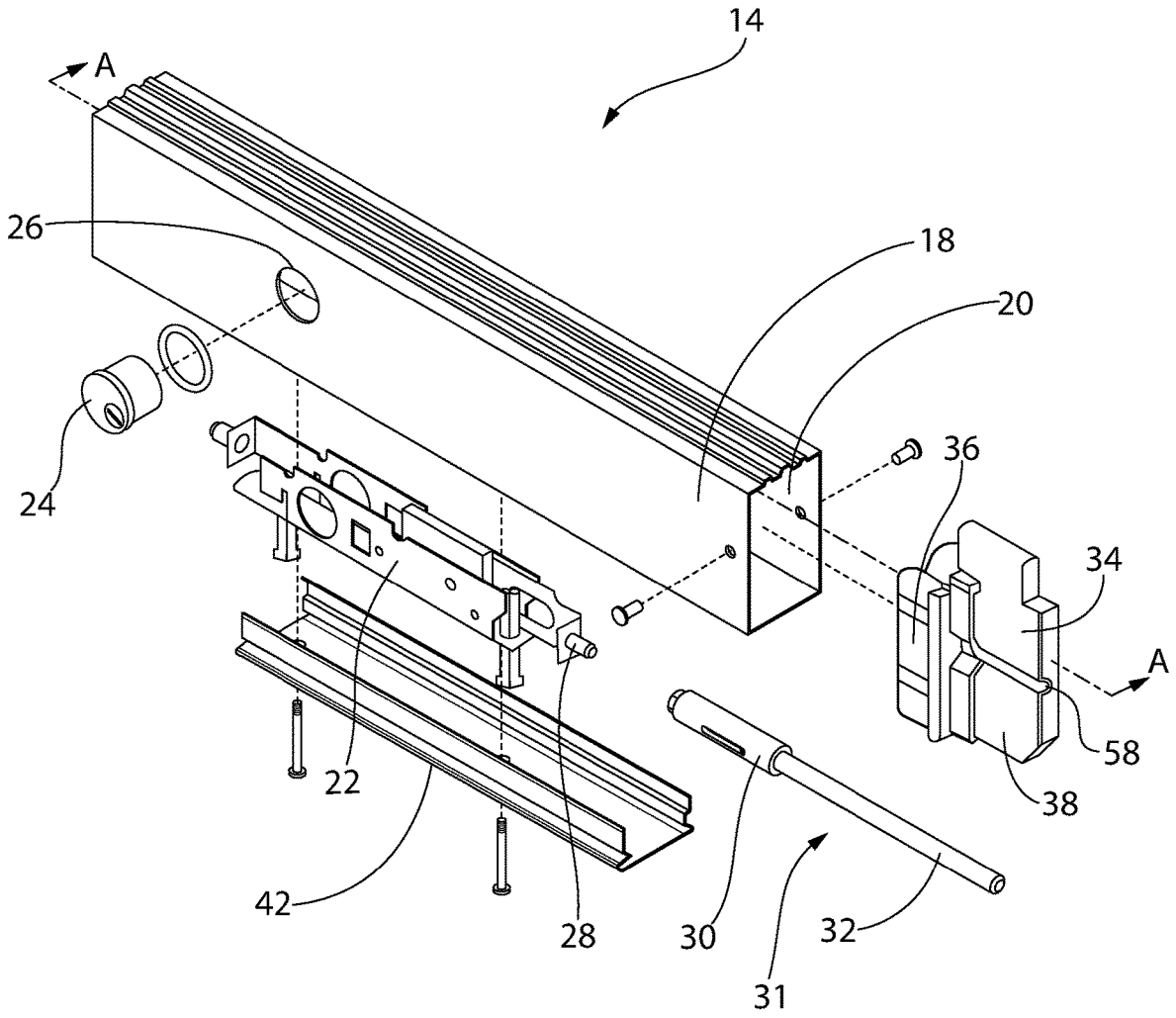
FIG. 2 is an exploded top perspective view of the door lock of FIG. 1.

Turning now to FIG. 2, the lock 14 may include a housing 18 which may be coupled to the door 16 and have an internal cavity 20 to receive the internal components of the lock 14. The housing 18 may be formed from the same material as the door 16 or may be formed of a different material having different properties than the door (e.g., heat resistant, higher material strength). In one embodiment, a moveable actuator 22 is within the cavity 20 and moves with respect to the housing 18 from a first position to a second position. In one embodiment, the actuator 22 moves toward an end of the housing as it moves from the first position to the second position. One type of actuator contemplated for use with the present device is described in U.S. Pat. No. 4,272,974, the disclosure of which is hereby incorporated herein by reference in its entirety. A locking element 24 (e.g., mortise cylinder) may be coupled to the actuator 22 to lock the actuator 22 in the second position. In one embodiment, a hole 26 is formed in the housing to allow access for a user to use a key (not shown) to lock the lock 14. The actuator 22 may include a stud 28 adapted to be coupled to a pin assembly 31 having a bolt 30 (e.g., via threaded engagement, welding, ball and detent, bayonet lock). The pin assembly 31 may be moveable with respect to the housing 18 when the actuator 22 moves. In one embodiment, the pin assembly 31 includes a pin 32 coupled to the bolt 30 and the pin 32 is moveable with respect to the bolt 30 and housing 18, as explained in greater detail below. A plug 34 may be at least partially positioned within the housing 18. In one embodiment, a first portion 36 of the plug 34 may be within the housing 18 and a second portion 38 of the plug 34 may be within a track 40 (best seen in FIG. 7) to align the lock 14 with the track 40. The housing 18 may include a removable access panel 42 which covers an opening (not shown) in the housing 18. In one embodiment, the opening (not shown) may allow a user to repair, modify, or remove any of the internal components of the housing 18 while the door 16 and the housing 18 are engaged with the track 40. For example, a user may remove the access panel 42, detach an existing lock bar from the actuator 22, and attach the pin assembly 31 without disengaging the housing 18 from the track 40. The access panel 42 may be located on any side of the housing 18 and need not necessarily be located on a bottom surface thereof. However, locating the access panel 42 on the bottom surface may increase the security of the door by preventing unwanted persons from removing the access panel 42 to remove internal components and open the door.

Figure 3:
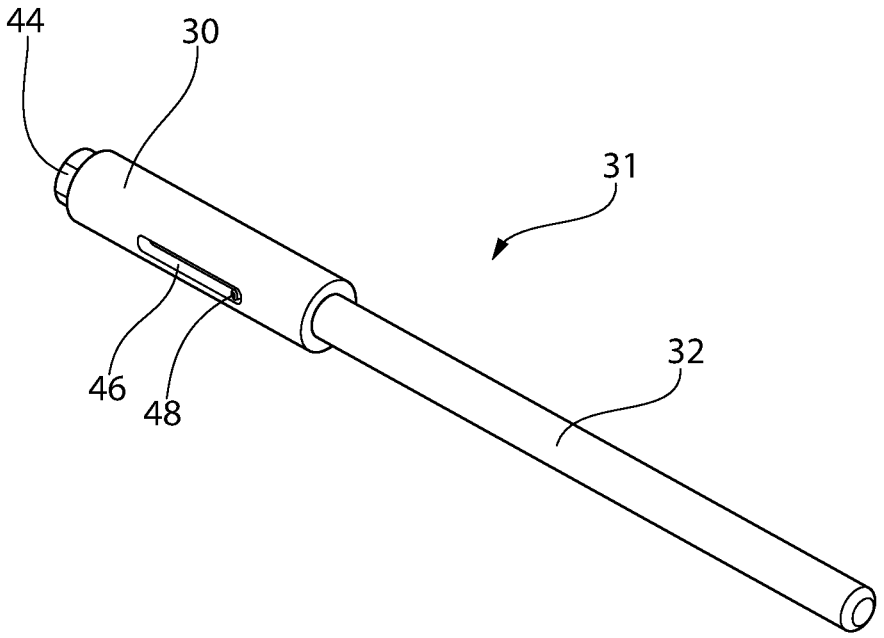
FIG. 3 is a top perspective view of the pin assembly of FIG. 2.

Referring now to FIG. 3, the bolt 30 may include a cavity (not shown) that may be disposed within bolt 30 to receive the pin 32. The bolt 30 may include a coupling 44 which can be attached to the stud 28 (e.g. via adhesive, welding, nut and bolt, hook and loop) on the actuator 22 such that movement of the actuator 22 causes movement of the bolt 30 from the first position to the second position. The coupling 44 may be attached to an end of the bolt 30 or a side thereof. The bolt 30 may be coaxial with the stud 28 when the coupling 44 is attached to an end of the bolt 30. A channel 46 may be formed in the bolt 30 which is adapted to receive an arrestor 48 (best seen in FIG. 4). The channel 46 may extend through a sidewall of the bolt 30 or may be a recess which does not extend completely through the sidewall. The channel 46 could also be a protrusion, rail, etc. that engages a feature of the pin 32 to limit movement of the pin 32 with respect to the bolt 30. In one embodiment, the bolt 30 and the pin 32 are both moveable along the same axis. In one embodiment, the bolt 30 may move between the first position and the second position when the locking element 24 is unlocked and is prevented from moving when the locking element is locked. In another embodiment, the pin 32 may move from the extended configuration to the contracted configuration when the locking element 24 is locked or when the locking element is unlocked.

Figure 4:
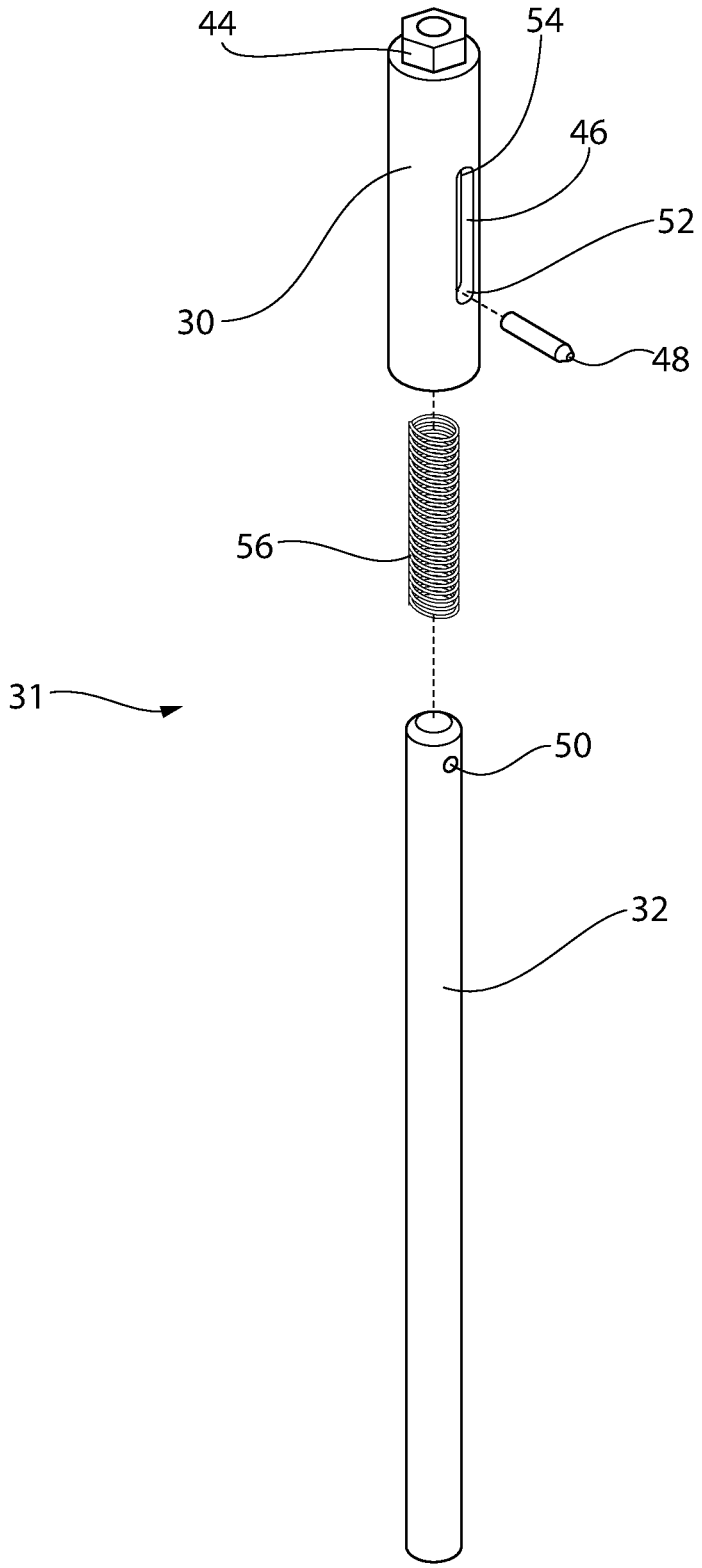
FIG. 4 is an exploded view of the pin assembly of FIG. 3.

Referring to FIG. 4, the pin 32 may include an aperture 50 to receive the arrestor 48. Alternatively, the arrestor 48 may be coupled to the pin 32 via adhesive, welding, etc. In one embodiment, the arrestor 48 is fixedly secured to the pin 32 such that as the pin moves with respect to the bolt 30, the arrestor 48 is moveable within the channel to contact the ends of the channel 46 to prevent further movement of the pin 32. The interaction of the arrestor 48 and the channel 46 may also prevent rotational movement of the pin 32 with respect to the bolt 30. For example, the pin 32 may have a cross-sectional shape other than round to prevent relative rotation between the bolt 30 and pin 32. In another example, the channel 46 may be wider than the arrestor 48 to allow some rotational movement between the channel 46 and arrestor 48. In one embodiment, the channel 46 extends along a path generally parallel to the bolt axis (not shown). In other embodiments, the channel 46 extends along a curved path which causes the pin 32 to rotate as the arrestor 48 moves along the curved path. The pin 32 may be moveable with respect to the bolt 30 from an extended configuration wherein the arrestor 48 contacts or is positioned toward a first end 52 of the channel 46 to a contracted configuration wherein the arrestor 48 contacts or is positioned toward a second end 54 of the channel 46. The cavity (not shown) of the bolt 30 may be configured to receive a biasing element 56 (e.g. a spring, pressurized piston within a cylinder, electromagnets) which biases the pin 32 toward the extended configuration. A gasket (not shown) in the cavity may prevent debris from entering the cavity. In one embodiment, the biasing element 56 is a spring contacting a surface (e.g. an end, a rim) of the cavity and the arrestor 48 to bias the pin 32 toward the extended configuration. In one embodiment, the biasing element 56 is a spring exerting zero or minimal force on the arrestor 48 when the pin 32 is in the extended configuration. In another embodiment, the force exerted by the biasing element 56 is lower when the pin 32 is in the extended configuration than when the pin is in the contracted configuration. In another embodiment, the force exerted by the biasing element 56 on the pin 32 is substantial when the pin is in the extended configuration, but is still less than the force exerted by the biasing element on the pin when the pin is in the contracted configuration. The length of the channel 46 may be selectable to a desired amount of relative movement between the pin 32 and bolt 30 as desired.

Figure 5:
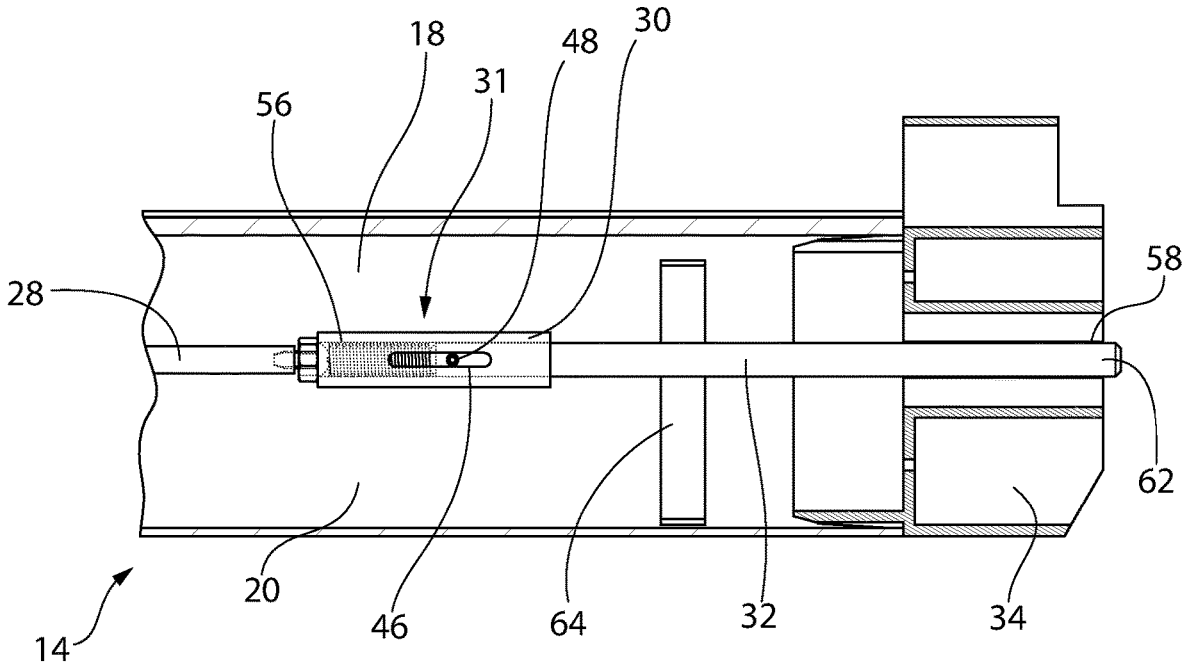
FIG. 5 is a front sectional view along a plane defined by line A-A of the lock of FIG. 2.

Referring now to FIG. 5, the plug 34 may include an aperture 58 adapted to receive the pin 32. The aperture 58 may allow at least a portion of the pin 32 to extend through the plug 34 to be engageable with a strike plate 60 in the track 40 as explained in greater detail below. In one embodiment, an end 62 of the pin 32 is flush with, or recessed with respect to, an end of the plug 34 (e.g., when the bolt 30 is in the first position and the pin 32 is in the extended configuration. In another embodiment, the end of the pin 62 may extend beyond the end of the plug 34 when the bolt 30 is in the first position and the pin 32 is in the extended configuration. In one embodiment, the housing includes a stabilizer means (e.g., a stabilizer 64) for aligning the pin assembly with the aperture. The stabilizer 64 may be coupled to the pin 32 to at least partially assist in aligning the pin 32 with the aperture 58. In one embodiment, the stabilizer 64 is fixed to the pin 32 and moves with the pin 32 relative to the plug 34. The stabilizer 64 may assist in limiting movement of the pin 32 by contacting the plug 34 and preventing further movement of the pin when the stabilizer 64 is fixed to the pin 32. In other embodiments, the stabilizer 64 is fixed to the housing 18 and the pin 32 moves through an opening (not shown) in the stabilizer 64. In one embodiment, the stabilizer 64 is fixed to the housing 18 and the bolt 30 is adjacent or in contact with the stabilizer 64 when the bolt 30 is in the second position. The stabilizer 64 may be fixed to the access panel 42 and the stabilizer 64 may be replaced by disengaging it from the access panel 42 and interchanging a new one.

Figure 6:
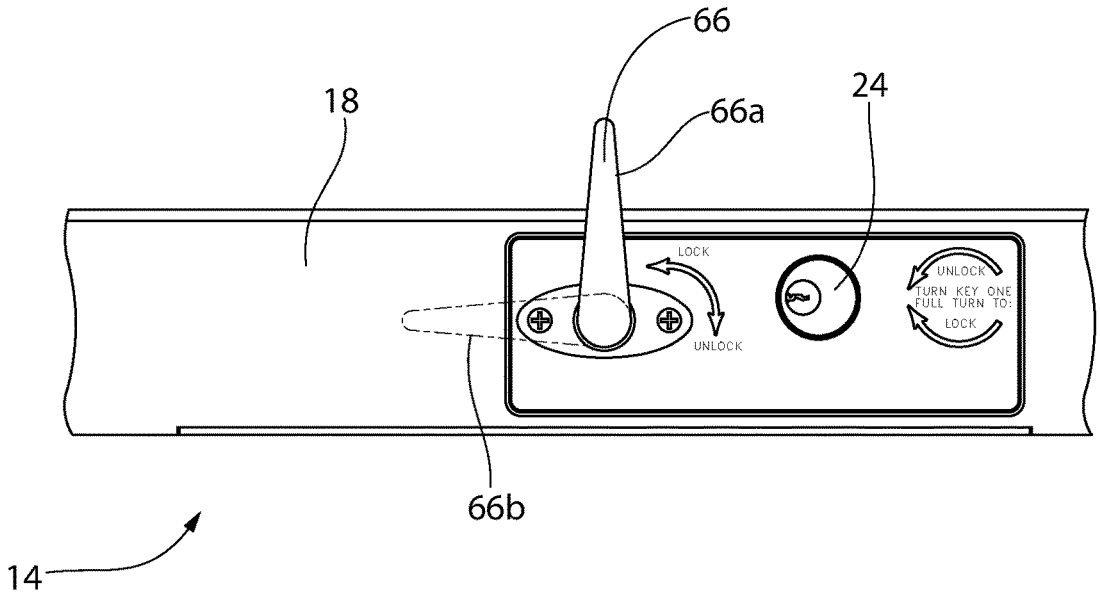
FIG. 6 is a front elevational view of the door lock of FIG. 1 with an actuator.

Turning now to FIG. 6, the lock 14 may include an activator 66 coupled to the actuator 22 to move the bolt 30 from the first position to the second position. In one embodiment, the bolt 30 is spaced from the end of the housing 18 by a first distance when the bolt 30 is in the first position and a second distance when in the second position, wherein the second distance is less than the first distance. The activator 66 may be a handle, crank, slide, rod, etc. that effectuates movement of the actuator 22. The activator may move from a first setting **66*a* when the bolt 30 is in the first position to a second setting 66*b* when the bolt 30 is in the second position. In one embodiment, the activator 66 may be removable from the housing 18. In another embodiment, the activator 66 may be a switch connected to a motor to move the actuator 22. In one embodiment, the locking element 24 may only be transitioned to the locked configuration when the activator 66 is in the second setting 66*b* and the bolt 30 is in the second position. In another embodiment, the locking element 24 may be transitioned to the locked configuration when the activator 66 is in either the first setting 66*a*. The pin 32 may move in concert with the bolt 30** between the first position and the second position.

Figure 7:
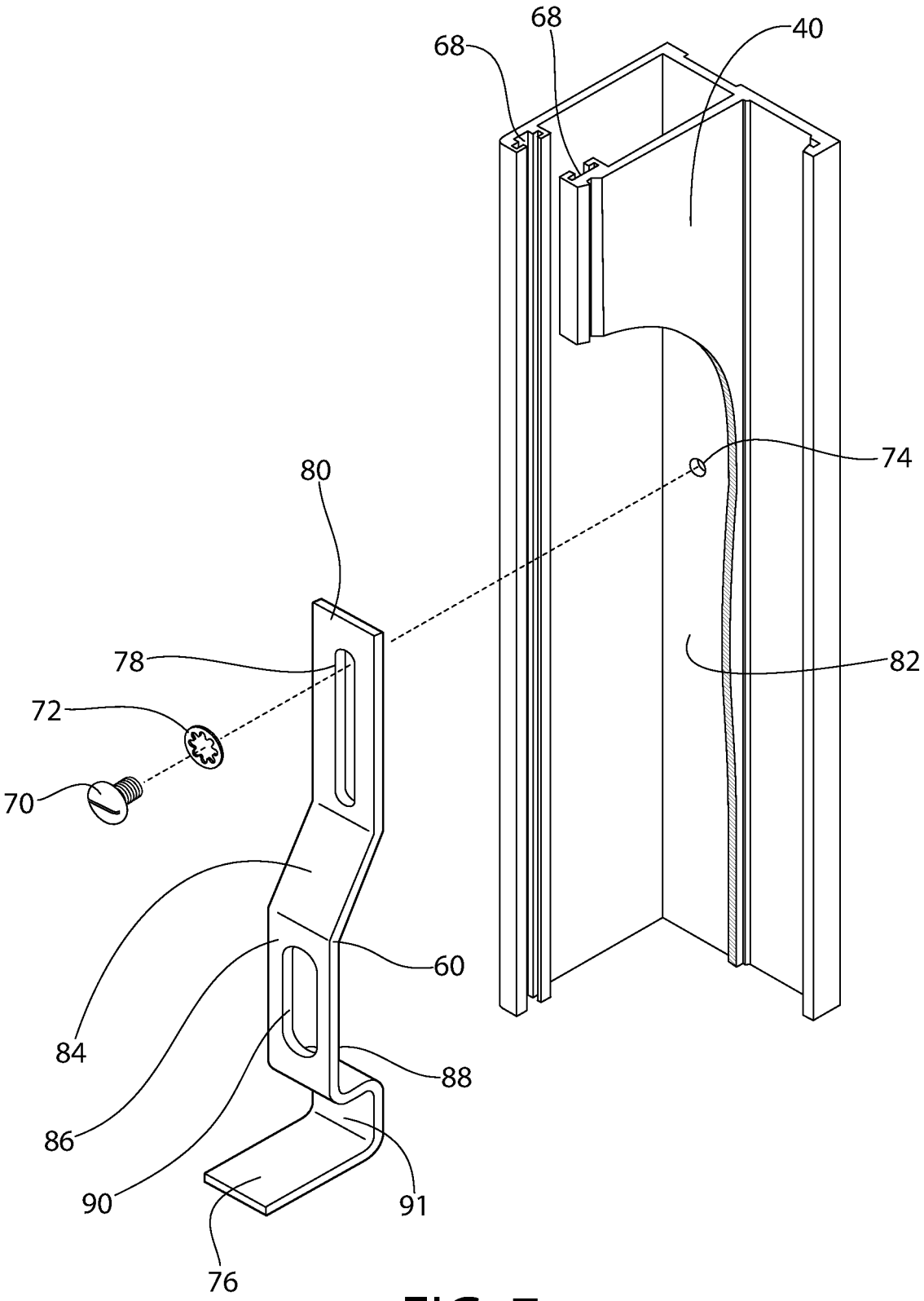
FIG. 7 is a side perspective view of a track with a strike plate in accordance with an exemplary embodiment of the present invention.

Referring now to FIG. 7, the door 16 may move within a track 40 when the door 16 is opened and closed. In one embodiment, the track 40 includes a seal feature such as a coupler 68 (e.g., a groove, recess) engageable with a portion of the plug 34. In another embodiment, the coupler 68 receives a seal (e.g. silicone, rubber) to prevent or reduce the passage of gas through the doorway when the door 16 is closed. The strike plate 60 may be positioned within the track 40. In one embodiment, the pin 32 may move along a free portion of the track 40 until the pin 32 contacts the strike plate 60. In one embodiment, the strike plate 60 and track 40 are formed monolithically with each other. In another embodiment, the strike plate 60 and track 40 are separate elements that may be coupled together prior to the track 40 being installed in the doorway. In another embodiment, the strike plate 60 is coupled to the track 40 after the track is installed in the doorway. In one embodiment, the strike plate 60 is coupled to the track 40 by a screw 70 and washer 72 within a hole 74 (e.g. threaded hole). In another embodiment, the strike plate 60 is coupled to the track by welding, adhesive, nails, flexible connector (e.g. rope, wire), hook and loop (e.g. Velcro), ball and detent structure, or the like. The track 40 may include any number of strike plates 60. In one embodiment, the track 40 includes more than one strike plate 60 which allows the door 16 to be secured at various positions along the track 40. In one embodiment, the track 40 includes a plurality of strike plates 60 which are spaced from each other along the track 40. In one embodiment, at least one of the plurality of strike plates 60 does not include a foot 76. In one embodiment, any of the plurality of strike plates 60 which are spaced from a lower surface or floor do not need to include a foot 76. In one embodiment, a track 40 is installed on each side of the doorway (not shown) and each track 40 includes a strike plate 60. The strike plate 60 may include a foot 76 which contacts a boundary (e.g. ground, floor, windowsill) of the opening to be sealed by the door 16. In one embodiment, the foot 76 is adjacent the ground or floor such that the door 16 is secured at the bottom of the track 40. The strike plate 60 may include a back 80 which is adjacent to, or in contact with, an end 82 of the track 40 when the strike plate 60 is coupled to the track 40. A slot 78 may be formed in the back 80 to receive a connector to secure the strike plate 60 to the track 40. In one embodiment, the slot 78 is elongated and allows limited relative movement between the strike plate 60 and the track 40 after the screw 70 is coupled to the opening 74. In another embodiment, the strike plate 60 includes more than one slot 78. A ramp 84 may extend between the back 80 and a face 86 of the strike plate 60. The ramp 84 may be straight, curved, stepped, etc. and extend outwardly away from the end 82 of the track 40 such that a rear surface 88 of the face 86 is spaced from the end 82 of the track 40. In one embodiment, the face 86 is parallel to the end 82. In another embodiment, the face 84 is oblique to the end 82. An opening 90 may be formed in the face 86 which receives the pin 32 when the door 16 is closed as explained in greater detail below. In one embodiment, the opening 90 is slightly larger than the pin 32 to allow the pin 32 to enter the opening 90 but provide only limited movement of the pin 32 once it is within the opening 90. In another embodiment, the opening 90 is elongated to allow easier alignment of the pin 32 within the opening 90. The opening 90 may be circular, square, triangular, or any other desired shape provided that it is large enough to receive at least a portion of the pin 32. In one embodiment, the strike plate 60 includes more than one opening 90. In one embodiment, the strike plate 60 includes an offset portion 91 between face 86 and the foot 76 and the offset portion is configured to engage the track 40. In one embodiment, the strike plate 60 does not include an opening 90 and instead, the pin 32 is secured in a recess (e.g., adjacent the offset portion 91) between the face 86 and the foot 76. The strike plate 60 may fit between the couplers 68 of the track 40 such that the strike plate 60 may be replaced after the track 40 has been installed, if desired. For example, the strike plate 60 could be removed from the track 40 and a strike plate 60 having a feature (e.g. opening, ramp, slot, foot) with a different parameter (e.g. size, shape, location) could be installed.

Figure 8:
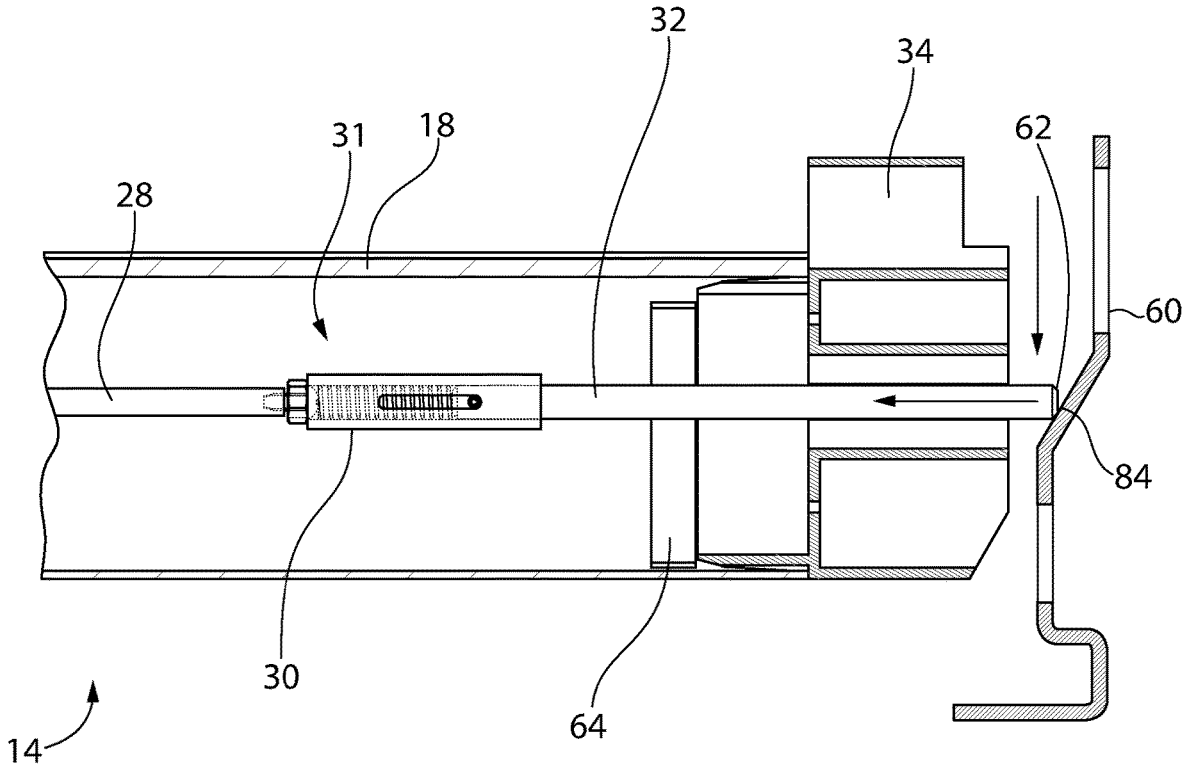
FIG. 8 is a front sectional view of the door lock of FIG. 1 with the bolt in a second position and pin in the extended configuration and adjacent the strike plate of FIG. 7.

Referring to FIG. 8, a cross-sectional view depicting one foreseeable use of the lock 14 is shown. The track 40 and door 16 are not shown for ease of discussion but the strike plate 60 would be positioned in the track 40 and the door would be connected to the housing 18 as previously described. In the embodiment shown, the activator 66 (FIG. 6) is in the second setting **66*b* such that the bolt 30 is in the second position when the end 62 of the pin 32 contacts the strike plate 60. For example, a user may partially move the door 16 along the track 40, move the activator 66 from the first setting 66*a* to the second setting 66*b*, and activate the locking element 24 prior to fully closing the door. The pin 32 may remain in the extended configuration and move in concert with the bolt 30 between the first position and the second position. The door 16 may then be moved further along the track 40 until the pin 32 contacts the strike plate 60. In one embodiment, the end 62 of the pin 32 contacts the ramp 84. In one embodiment, the end 62 of the pin 32 contacts the end 82 of the track 40 when the pin is in the extended configuration. In one embodiment, the end 62 of the pin 32 is frustoconical or chamfered to assist in moving the pin to the contracted configuration when the pin contacts the strike plate 60. The stabilizer 64 may be spaced from the plug 34 when the bolt 30 is in the first position and adjacent the plug 34 when the bolt 30 is in the second position and the pin 32** is in the extended configuration.

Figure 9:
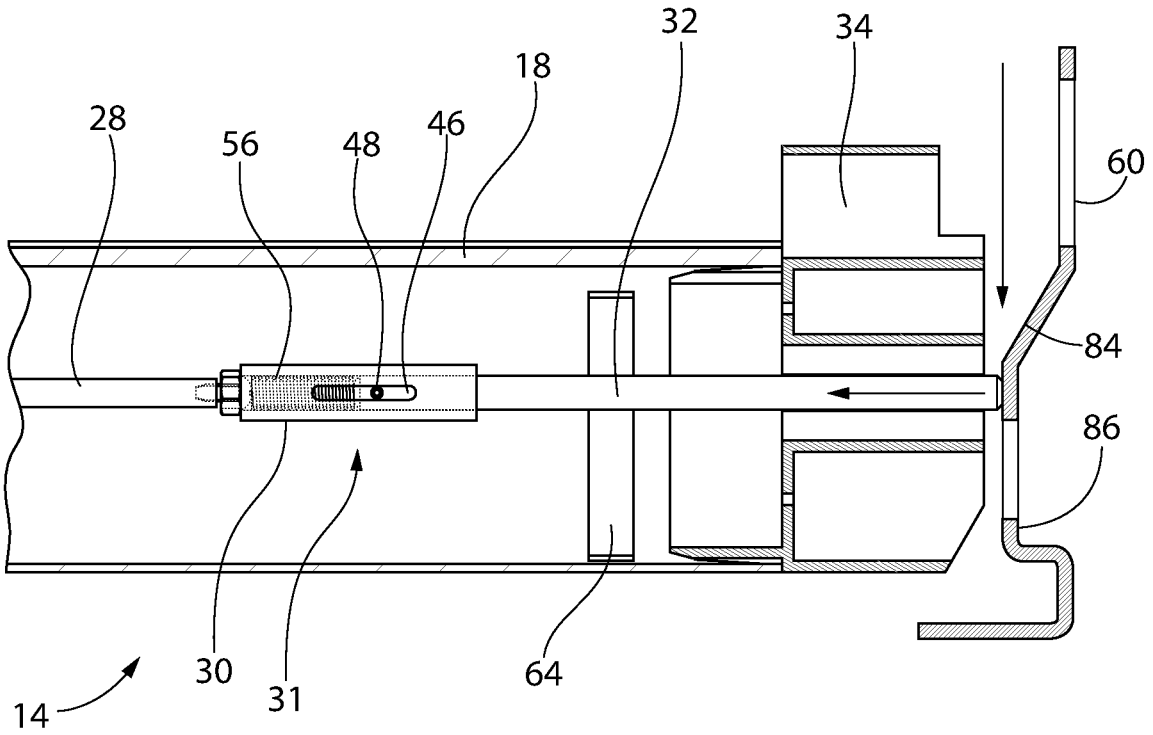
FIG. 9 is a front sectional view of the door lock of FIG. 1 with the bolt in a second position and the pin in a contracted configuration and adjacent the strike plate of FIG. 7.

Referring to FIG. 9, the pin 32 may move from the extended configuration (FIG. 8) to the contracted configuration (FIG. 9) as the door 16 continues to move along the track 40 and the pin 32 engages the ramp 84 of the strike plate 60 (e.g., when the door moves relative to the track 40 and the pin is disposed within the track 40). The bolt 30 may remain in the second position while the pin 32 independently moves between the extended configuration and the contracted configuration. The biasing element 56 may be distorted (e.g. elongated, compressed) when the pin 32 is in the contracted configuration such that the biasing element 56 applies a force to the pin 32. The stabilizer 64 may be spaced from the plug 34 when the bolt 30 is in the second position and the pin 32 is in the contracted configuration.

Figure 10:
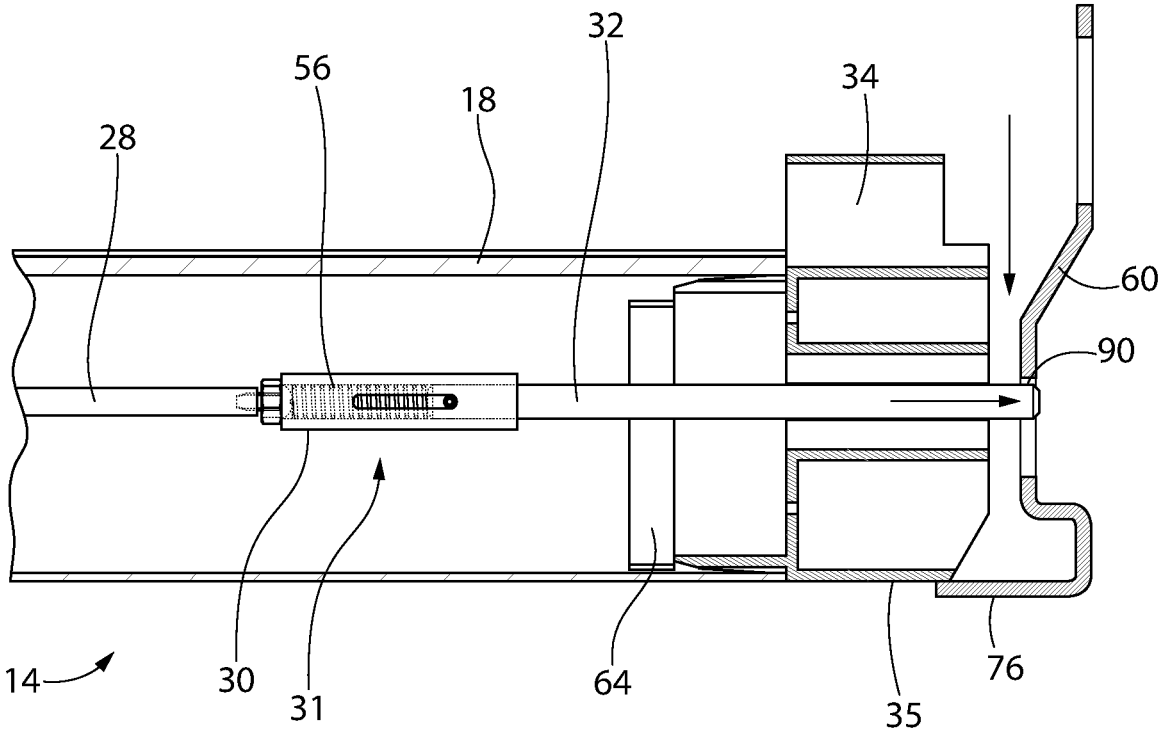
FIG. 10 is a front sectional view of the door lock of FIG. 1 with the bolt in a second position and the pin in an extended configuration and within an opening in the strike plate of FIG. 7.

Referring to FIG. 10, the biasing element 56 may apply a force to the pin 32 and move the pin 32 (e.g. when the biasing element decompresses) to the extended configuration when the pin 32 is aligned with the opening 90 in the strike plate 60. In one embodiment, the stabilizer 64 is adjacent the plug 34 when the pin 32 is within the opening 90. In another embodiment, the stabilizer 64 is spaced from the plug 34 when the pin 32 is within the opening 90. In one embodiment, a user activates the locking element 24 after the pin 32 is within the opening 90. In another embodiment, the user activates the locking element 24 before the pin 32 is within the opening 90. The pin 32 may move between the extended configuration and the contracted configuration even after the locking element 24 is locked because the pin 32 may move independently of the bolt 30. The door 16 may be secured when the pin 32 is within the opening 90 and the locking element 24 is in the locked configuration. The user may unlock the door by unlocking the locking element 24 and moving the activator 66 to the first setting **66*a*, thereby moving the bolt 30 to the first position. The pin 32 may move in concert with the bolt 30 between the second position and the first position, thereby disengaging the pin 32 from the strike plate 60. The door 16 may then be moved along the track 40. It is believed that adopting a pin 32 which may move from the extended configuration to the contracted configuration even after the activator 66 is moved and the locking element 24 is locked will reduce or eliminate damage to the track 40, strike plate 60, and lock 14 when a user locks the door prior to fully closing the door. In one embodiment, a bottom 35 of the plug 34 or the lock 14 may contact the foot 76 when the door 16 is in the extended configuration. In one embodiment, the foot 76 prevents further movement of the bottom 35, and thus the door 16, along the track 40**.

Figure 11:
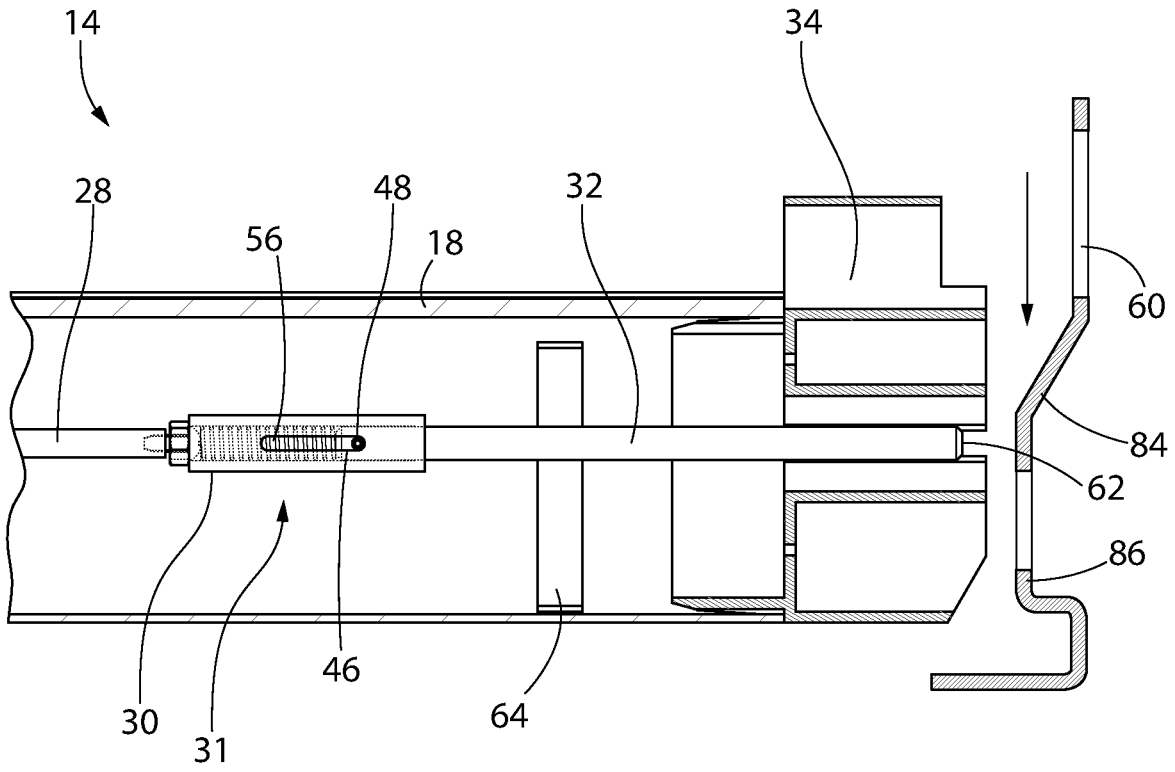
FIG. 11 is a front sectional view of the door lock of FIG. 1 with the bolt in a first position and the pin in the extended configuration and adjacent the strike plate of FIG. 7.

Referring to FIG. 11, the door may also be secured by moving the door along the track 40 with the bolt 30 in the first position. In one embodiment, the pin 32 is in the extended configuration and does not contact the ramp 84 as the door moves along the track 40 when the bolt 30 is in the first position. In other words, securing the door can occur without distorting the biasing element 56. Thus, the door 16 can move along the track 40 without the biasing element 56 exerting a force on the pin 32. The user may move the bolt 30 to the second position once the pin 32 is aligned with the opening 90 in the strike plate 60 such that the door is secured without the biasing element 56 exerting any force on the pin 32. The user may move the locking element 24 to the locked configuration once the pin 32 is within the opening 90 (FIG. 10). In one embodiment, the user may move the door 16 along the track 40 with the bolt in the first position and secure the door without the biasing element 56 applying a force to the pin, unlock and open the door, then close the door with the bolt 30 in the second position such that the biasing element 56 exerts a force to move the pin 32 into the opening 90 as the door is secured.

Figure 12:
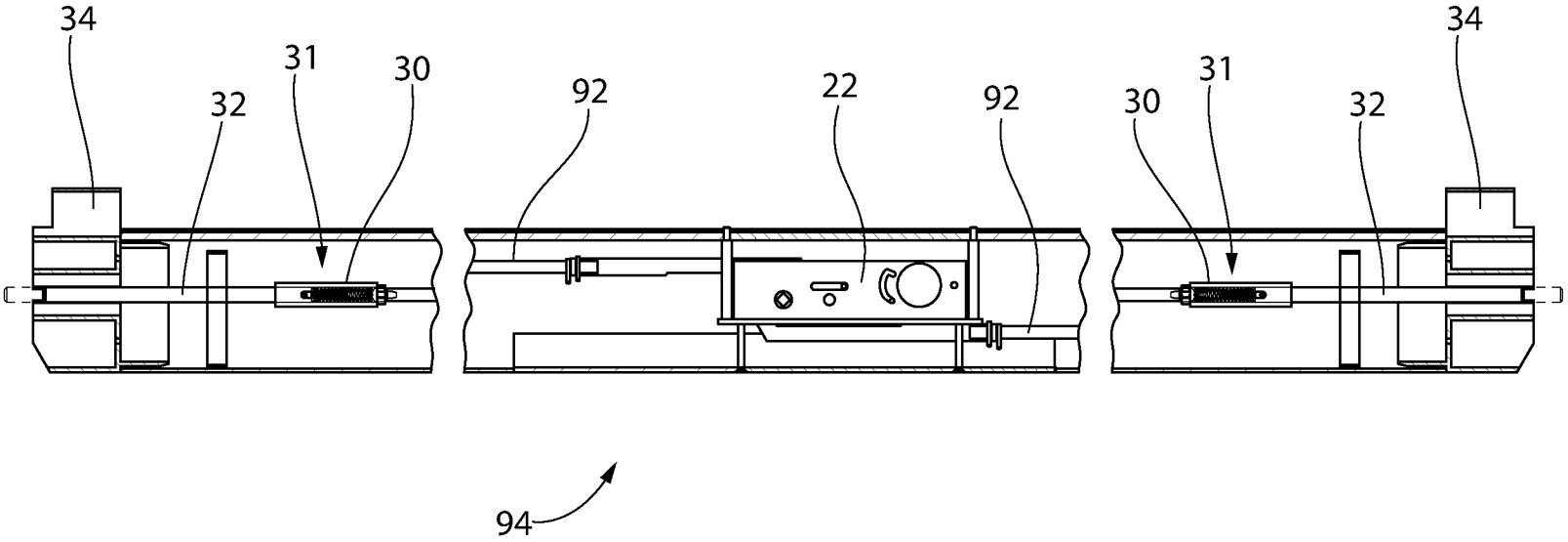
FIG. 12 is a front sectional view of a door lock in accordance with another exemplary embodiment of the present invention.

Referring to FIG. 12, there is shown a second embodiment of the lock, generally designated 94. The lock 94 is similar to the first embodiment of the lock except that the housing 18 may include a second bolt, pin, plug, etc. to engage a second strike plate in a second track (not shown). In one embodiment, the actuator 22 and activator 66 simultaneously move both bolts. In another embodiment, the bolts are moved independently of each other. A connecting rod 92 may couple the bolt 30 to the actuator 22.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. The words "right", "left", "lower" and "upper" designate directions in the drawings to which reference is made. The words "inwardly" and "outwardly" refer to directions toward and away from, respectively, the geometric center of the lock. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

I claim:

1. A lock for a retractable door that is moveable along a track, the lock comprising: a pin assembly coupled to the door and moveable with respect to the door from a retracted configuration to an extended configuration; a biasing element configured to bias the pin assembly toward the extended configuration; and a strike plate in the track, the strike plate configured to mate with the pin assembly; and a plug having an aperture configured to align the pin assembly with the strike plate, wherein with the pin assembly is configured to extend through the aperture, wherein the door is prevented from moving along the track when the pin assembly is mated with the strike plate, and wherein the retractable door includes a housing configured to receive the pin assembly; and wherein the pin assembly is moveably coupled to a bolt that is moveable, with respect to the door, between a first position and a second position, the door being lockable when the bolt is in the second position; wherein the pin assembly is adapted to move in concert with the bolt from the first position to the second position and move independently of the bolt from the retracted configuration to the extended configuration.

2. The lock of claim 1, wherein the pin assembly is adapted to move from the extended configuration to the retracted configuration as the door moves relative to the strike plate while the pin assembly is engaged with the strike plate.

3. The lock of claim 1 further comprising a locking element adapted to lock the bolt in the second position.

4. The lock of claim 3, wherein the locking element is adapted to attain the second position whether or not the pin is mated with the strike plate.

5. The lock of claim 4, wherein the lock is configured to cooperate with the door and the track such that when the bolt is in the second position, at least a portion of the pin assembly is disposed within the track and the door is movable along the track when the pin assembly is within a free portion of the track and the door is not moveable along the track when the pin assembly is mated with the strike plate.

6. The lock of claim 1, further comprising a stabilizer coupled to the pin assembly, the stabilizer aligning the pin assembly with the aperture.

7. The lock of claim 6, wherein the stabilizer is fixed to the pin assembly and the stabilizer moves as the pin assembly transitions between the contracted configuration and the extended configuration.

8. The lock of claim 7, wherein the stabilizer is adjacent the plug when the pin assembly is in the extended configuration and is spaced from the plug when the pin assembly is in the contracted configuration.

9. The lock of claim 1, wherein the biasing element is a spring and the spring is un-stressed when the pin assembly is in the extended configuration.

10. The lock of claim 3, further comprising a connecting rod coupling the bolt to the locking element.

11. The lock of claim 2, wherein the lock is configured to transition into a locked configuration when the bolt is in the second position and the pin assembly is in the extended configuration by movement of the door along the track toward the strike plate such that the biasing element compresses when the pin assembly engages the strike plate and decompresses when the pin assembly is aligned with an opening in the strike plate such that the pin assembly extends into the opening.

12. The lock of claim 11, wherein the lock is configured to transition into the locked configuration when the bolt is in the first position and the pin is in the extended configuration such that the biasing element remains uncompressed as the pin passes the strike plate and the bolt is moved to the second position such that the pin is within the opening.

13. The lock of claim 1, wherein the strike plate includes an opening and the pin assembly mates with the strike plate when the pin assembly is within the opening.

14. The lock of claim 1, wherein the strike plate includes a ramp portion extending away from the track, wherein the pin assembly is movable to the contracted configuration when the pin assembly engages the ramp.

15. The lock of claim 14, wherein the strike plate includes a face with an opening and the pin assembly is configured to mate with the strike plate when a portion of the pin assembly is disposed within the opening.

16. The lock of claim 15, wherein the strike plate includes a foot configured to be secured to a surface at a lower end of the track.

17. The lock of claim 2, wherein the strike plate includes a face disposed along the track, a foot, and an offset portion between the face and the foot, the offset portion configured to engage the track.

18. A method of securing a retractable door, comprising:

moving a bolt with respect to the retractable door from a first position to a second position, the bolt movably coupled to a pin assembly, the pin assembly moveable from a retracted configuration to an extended configuration;

locking the bolt in the second position;

moving the retractable door while the pin assembly is in the extended configuration;

engaging a strike plate with the pin assembly, thereby transferring the pin assembly to the retracted configuration; and aligning the pin assembly with the strike plate, thereby transferring the pin assembly to the extended configuration wherein the pin assembly is mated with the strike plate.

19. The method of claim 18, wherein the bolt includes a channel and the pin assembly includes an arrester within the channel configured to limit movement of the pin assembly with respect to the bolt.

20. The method of claim 18, wherein the moving the bolt step includes moving the pin assembly in concert with the bolt, and the engaging the strike plate step includes moving the pin assembly independently of the bolt.

21. The method of claim 18, wherein the pin assembly is configured to move from the retracted configuration to the extended configuration either before or after the locking step.

22. The method of claim 18, wherein the moving a bolt step includes moving the bolt and a second bolt with an actuator, the second bolt moving with respect to the door from a first position to a second position, the second bolt coupled to a second pin assembly moveable with respect to the second bolt from a retracted configuration to an extended configuration.

23. A method of securing a retractable door, comprising:

providing a retractable door having a bolt moveable from a first position to a second position, a pin assembly moveable from a contracted configuration to an extended configuration, the retractable door moveable along a track including a strike plate, and a biasing element;

closing the retractable door when the bolt is in the first position and the pin assembly is in the extended configuration such that the biasing element is uncompressed as the pin assembly passes the strike plate and the bolt is moved to the second position to engage the strike plate;

opening the retractable door; and closing the retractable door when the bolt is in the second position and the pin is in the extended configuration such that the biasing element is compressed as the pin assembly passes the strike plate and decompresses when the pin assembly is aligned with the strike plate such that the pin assembly is mated with the strike plate.

24. The method of claim 23, wherein providing the retractable door comprises retrofitting the bolt, pin assembly, and biasing element into an existing door by replacing a lock bar coupled to the existing door with the bolt, pin assembly, and biasing element.

25. The method of claim 24, wherein the lock bar is housed within a housing of the existing door and the method further includes accessing the lock bar within the housing prior to the replacing the lock bar step.

26. The method of claim 24, wherein the retrofitting step is performed while the existing door is engaged with the track.

* * * * *